US006684799B2

(12) United States Patent
Ninomiya et al.

(10) Patent No.: US 6,684,799 B2
(45) Date of Patent: Feb. 3, 2004

(54) SEWING MACHINE AND EMBROIDERING FRAME HAVING MEANS FOR DAMPING VIBRATION OF THE FRAME

(75) Inventors: Masashi Ninomiya, Tokyo (JP); Mikio Koike, Tokyo (JP); Koshiro Omiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 0 days.

(21) Appl. No.: 09/925,967

(22) Filed: Aug. 10, 2001

(65) Prior Publication Data

US 2002/0035953 A1 Mar. 28, 2002

(30) Foreign Application Priority Data

Aug. 11, 2000 (JP) ..... 2000-245433

(51) Int. Cl.[7] ..... D05C 9/04
(52) U.S. Cl. ..... 112/103
(58) Field of Search ..... 112/103, 470.06, 112/470.09, 470.14, 102.5; 38/102.2

(56) References Cited

U.S. PATENT DOCUMENTS 2,684,041 A * 7/1954 Tice ..... 112/470.09
5,040,476 A * 8/1991 Takenoya et al. ..... 112/103 X
5,065,684 A * 11/1991 Hansberry ..... 112/470.06 X
6,382,116 B2 * 5/2002 Wakasugi ..... 112/103

* cited by examiner

*Primary Examiner*—Peter Nerbun
(74) *Attorney, Agent, or Firm*—Lowe Hauptman Gilman & Berner LLP

(57) ABSTRACT

A sewing machine has a drive mechanism for driving an embroidering frame B, means for holding the embroidering frame B and operatively connected to the drive mechanism to be driven thereby to move the embroidering frame B in X-Y direction relative to a vertically reciprocating needle on the surface of a machine bed, and means for normally pressing the embroidering frame B against the surface of the machine bed with an optimal force to absorb the vibrations of the embroidering frame B which may be caused during embroidery stitching operation.

13 Claims, 7 Drawing Sheets

SEWING MACHINE AND EMBROIDERING FRAME HAVING MEANS FOR DAMPING VIBRATION OF THE FRAME

BACKGROUND OF THE INVENTION

1. Field of the Invention

The present invention relates to a sewing machine having an embroidery stitching function, and more particularly relates to a sewing machine having a function for damping the vibration of an embroidering frame which may be produced during embroidery stitching operation and further relates to an embroidering frame having a function for damping the vibration of itself, so that the embroidery stitching operation may be performed smoothly and steadily while the embroidering frame is held as being stabilized on the sewing machine bed.

2. Prior Art

Recently the sewing machine having a drive mechanism for driving an embroidering frame has been generally used. The drive mechanism includes a carriage for removably holding the embroidering frame. The carriage is partly extended out of the sewing machine frame and driven into and out of the sewing machine frame so as to be moved in X-Y direction, thereby to move the embroidering frame in X-Y direction accordingly relative to a vertically reciprocating needle on the surface of a machine bed. Thus the embroidery stitching operation is performed.

In case the embroidering frame is moved in X-Y direction on the surface of the machine bed, it is required that the embroidering frame is moved in a stabilized condition wherein the embroidering frame is constantly in close contact with the surface of the machine bed. According to the prior art, as shown in FIG. 7(*a*), the embroidering frame f mounted to the carriage c will often fail to correctly contact the surface of the machine bed b and float up from the surface of the machine bed b. This is because the precision is not sufficient in the parts of the drive mechanism and/or in the assembly thereof, or in the connecting part between the embroidering frame f and the carriage c.

On the other hand, as shown in FIG. 7(*b*), since the embroidering frame f is generally rigid and fails to have a movable part at the arm portion thereof by which the embroidering frame f is mounted to the carriage c, the embroidering frame f is often pressed against the surface of the machine bed b with a strong force which will produce a friction between the embroidering frame f and the surface of the machine bed b, thus hindering the movement of the embroidering frame f.

Further, the driving movement of a drive motor and the resultant operation movement of the embroidering frame drive mechanism may be transmitted to the embroidering frame to vibrate the same. This will often hinder the smooth and steady movement of the embroidering frame. Further, the vertically reciprocating needle will vibrate the embroidering frame up and down with the instantaneous force given to the cloth held by the same as the needle is moved up through the cloth. In any events, such vibrations will give adverse influence to formation of stitches and to the stitched result of embroidery patterns.

OBJECTS OF THE INVENTION

It is, therefore, a primary object of the invention to provide an embroidery sewing machine having a function for damping the vibrations of embroidering frame which may be caused during embroidery stitching operation.

It is another object of the invention to provide an embroidery sewing machine having a function for absorbing the vibrations of embroidering frame which may be caused during embroidery stitching operation.

It is another object of the invention to provide an embroidery sewing machine having a function for elastically pressing the embroidering frame against the surface of machine bed with an optimal force.

It is another object of the invention to provide a vibration damping or absorbing means which is simple in structure and in smooth in operation.

It is another object of the invention to provide elastic means in connection with the carriage for pivotally holding the embroidering frame to normally press the embroidering frame against the surface of machine bed.

It is another object of the invention to provide a means for regulating the pivotal movement of the embroidering frame to normally maintain an optimal contact between the embroidering frame and the surface of machine bed.

It is another object of the invention to provide elastic means at a proper part of the embroidering frame to normally deflect the embroidering frame to the surface of machine bed.

It is still another object of the invention to provide the carriage with an inclined surface as is progressively lowered towards the machine bed so as to normally deflect the embroidering frame to the surface of machine bed.

The other objects and advantages will be apparent in the following detailed description of the invention.

SUMMARY OF THE INVENTION

For attaining the objects, the invention substantially comprises an embroidering frame having a cloth held thereon to be stitched, a drive mechanism for moving the embroidering frame, means including a carriage for holding the embroidering frame and operatively connected to the drive mechanism to be moved thereby to move the embroidering frame in X-Y direction relative to a vertically reciprocating needle on the surface of a machine bed, and means for absorbing the vibrations of the embroidering frame which may be caused during embroidery stitching operation, wherein the vibration absorbing means includes a spring member provided in connection with the carriage or in connection with the embroidering frame so as to yieldably press the embroidering frame against the surface of the machine bed, and wherein the carriage is provided with an inclined surface as it is progressively lowered towards the machine bed to have the embroidering frame mounted thereto such that the embroidering frame may yieldably deflect up and down. The invention further comprises means for regulating the angular movement of the embroidering frame to normally maintain an optimal contact between the embroidering frame and the surface of machine bed.

(*a*) is a perspective view of the essential parts of a carriage of the invention for holding an embroidering frame;

(*b*) is a side elevational view of the essential parts of the carriage shown in vertical section;

(*c*) is a front elevational view of the essential parts of the carriage partly shown in vertical section;

FIG. 3

(*a*) is an enlarged side elevational view of the essential parts of the carriage shown in vertical section as partly moved in one direction;

(*b*) is an enlarged side elevational view of the essential parts of the carriage shown in vertical section as partly moved in the opposite direction;

(*c*) is another enlarged side elevational view of the essential parts of the carriage of (*a*) shown in vertical section to show the movement of the parts regulated in one direction;

(*d*) is another enlarged side elevational view of the essential parts of the carriage of (*b*) shown in vertical section to show the movement of the parts regulated in the opposite direction;

FIG. 4

(*a*) is a perspective view of the embroidering frame of the invention;

(*b*) is a side elevational view of the embroidering frame shown as being partly movable;

(*c*) is a side elevational view of the embroidering frame mounted to the carriage shown partly in vertical section;

FIG. 5

(*a*) is a perspective view of another embodiment of the embroidering frame of the invention;

(*b*) is an enlarged side elevational view of the essential parts of the embroidering frame shown in vertical section;

(*c*) is an enlarged side elevational view of another embodiment of the essential parts of the embroidering frame shown in vertical section;

(*d*) is a side elevational view of the essential parts of the embroidering frame shown as being partly movable;

(*e*) is a side elevational view of the embroidering frame mounted to the carriage shown partly in vertical section;

FIG. 6

(*a*) is a side elevational view of the essential parts of the invention showing one condition in case the invention is actually used;

(*b*) is a side elevational view of the essential parts of the invention showing another condition in case the invention is actually used;

FIG. 7

(*a*) is a side elevational view of a conventional sewing machine having a carriage and an embroidering frame mounted to the carriage shown partly in vertical section to show one condition of the embroidering frame in actual use;

(*b*) is a side elevational view of the conventional sewing machine having a carriage and an embroidering frame mounted to the carriage shown partly in vertical section to show another condition of the embroidering frame in actual use.

DETAILED DESCRIPTION OF PREFERRED EMBODIMENTS

The invention will be described in detail in reference to the preferred embodiments as shown in the attached drawings.

Figure 1:
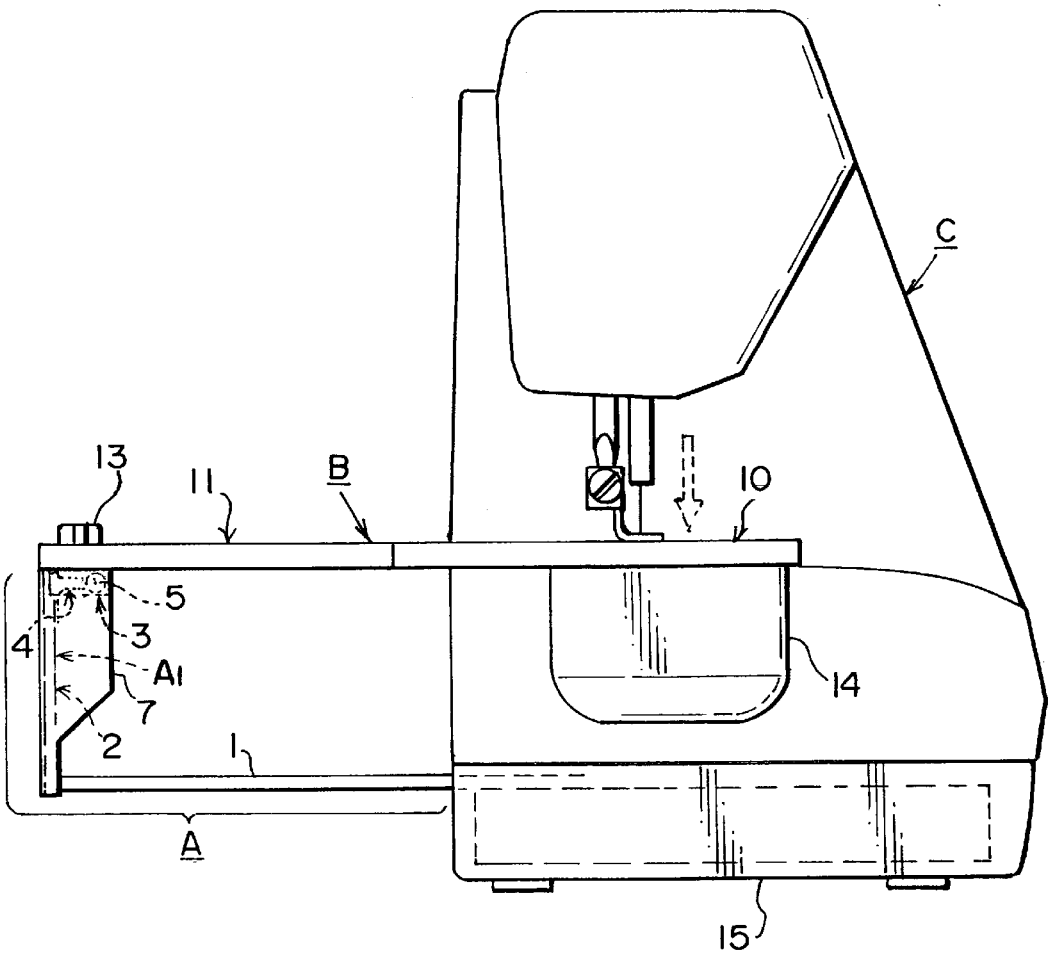
FIG. 1 is a side elevational view of a sewing machine having essential parts of the invention provided therewith.

A shown in FIG. 1, a sewing machine C has a hollow base 15 in which there is provided a mechanism for driving an embroidering frame B in X and Y directions. The frame driving mechanism includes a carriage A which is protruded out of the base 15 and removably hold the embroidering frame B at a distal end thereof to move the same on a machine bed 14 in X-Y direction.

A shown in FIG. 1, a sewing machine C has a hollow base 15 in which there is provided a mechanism for driving an embroidering frame B in X and Y directions. The frame driving mechanism includes a carriage A which is protruded out of the base 15 and removably holds the embroidering frame B at a distal end thereof to move the same on a machine bed 14 in X-Y directions.

Figure 2:
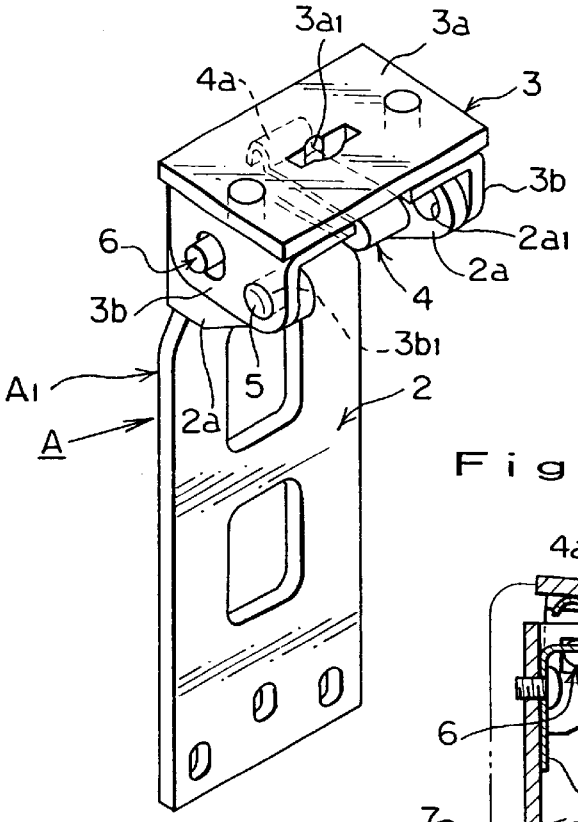
FIG. 2
Figure 2:
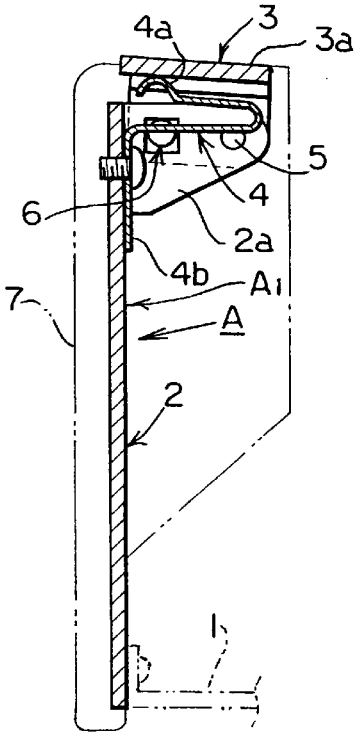
Figure 2:
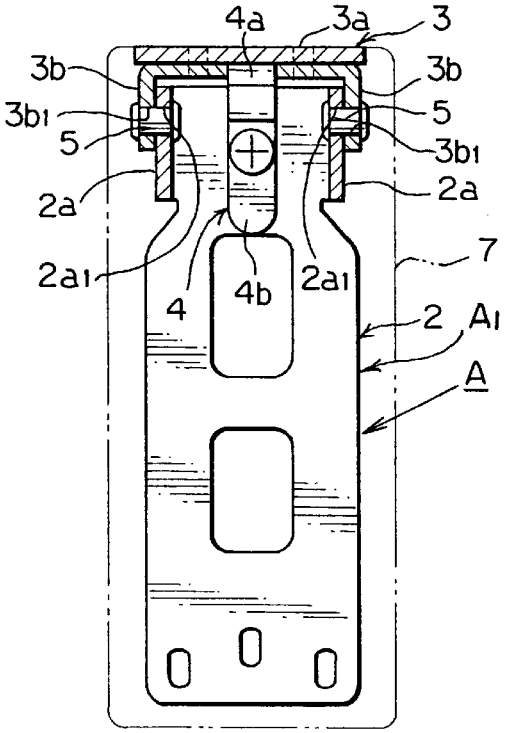

The support plate 2 is a rectangular plate made of metal or synthetic resin and has the upper part formed in U-shape to provide a pair of support arms 2*a*, 2*a* having holes $2a_1$, $2a_1$ formed thereat respectively. The mount 3 is formed in one body with an upper mount plate 3*a* and lower guide plates 3*b*, 3*b* which are L-shaped in section having holes $3b_1$, $3b_1$ formed thereat respectively and straddling the support arms 2*a*, 2*a* of the support plate 2 as shown in FIG. 2(*c*). The mount 3 with this structure is rotatably connected to the support plate 2 by means of a pair of studs 5, 5 inserted into the respective holes $2a_1$, $2a_1$, $3b_1$, $3b_1$ respectively.

As shown in FIG. 2 (*b*) and (*c*), the spring member 4 is a substantially U-shaped metal plate having one end portion 4*b* fixed to the support plate 2 and the opposite swelled end portion 4*a* pressed against the mount plate 3*a* at the lower side thereof to normally give pressure to the mount plate 3*a* to rotate the same clockwise (FIGS. 2 (*b*), 3 (*a*) and (*b*)) around the support studs 5, 5, thereby to normally incline the same as it is progressively lowered towards the machine bed 14. Namely, the spring member 4 is provided to act on one end of the embroidering frame B to normally press the opposite end of the embroidering frame B against the bed surface of the sewing machine, thereby to absorb the vibrations of the embroidering frame B which may otherwise be produced during embroidery stitching operation. The spring member 4 may be a compression spring or a torsion spring instead of the above mentioned U-shaped plate spring.

Figure 3:
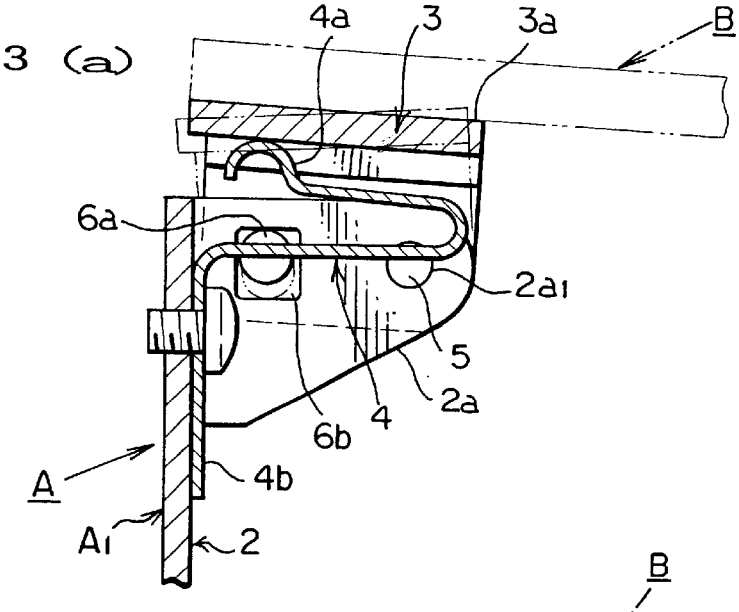
Figure 3:
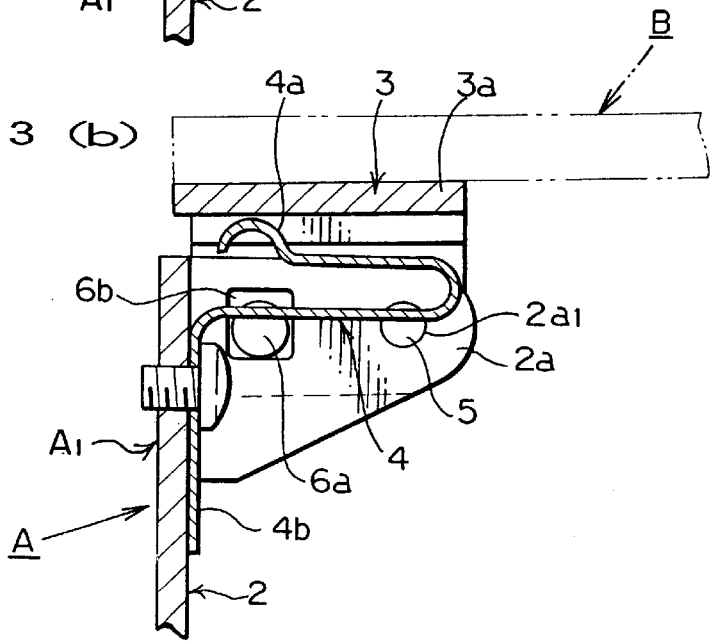
Figure 3:
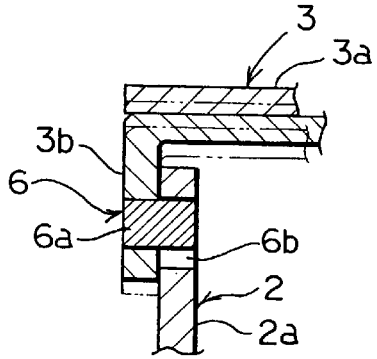
Figure 3:
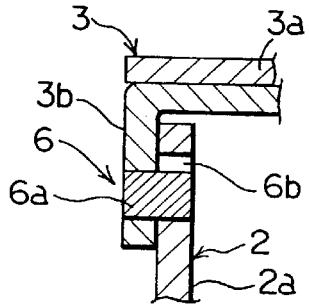

More precisely, according to the invention, the rotation of the mount 3 around the studs 5, 5 is regulated by regulating means 6 as shown in FIGS. 3 (*a*) to (*d*) wherein the positions of the stud 6*a* are shown to be regulated by the opening 6*b*. The regulating means 6 include studs 6*a*, 6*a* having one end portion fixed to the guide plates 3*b*, 3*b* respectively and the opposite end portion inserted into openings 6*b*, 6*b* formed at the support arms 2*a*, 2*a* respectively, the opening 6*b* being of an diameter larger than the diameter of the stud 6*a* so that the opening 6*b* may regulate the angular movement of the stud 6*a*, and hence, of the mount 3.

The angular regulation region is preferred to be smallest possible so that the angular movement of the mount 3 may be smallest up and down from the horizontal condition of the mount 3. Further, the smallest angular movement regulation of the mount 3 in the clockwise direction in FIGS. 3(*a*) and (*b*) will make it easy to mount the embroidering frame B to the mount 3. As to the angular movement regulating means 6, the studs 6*a*, 6*a* may be fixed to the support arms 2*a*, 2*a* of the support plate 2 respectively and inserted into the openings 6*b* respectively which may be formed at the guide plates 3*b*, 3*b* of the mount 3 respectively. The support plate 2 and the mount 3 are covered with a cover member 7 to protect the inside structure of the carriage A and to prevent the cloth from being caught by the members of the carriage A.

Subsequently, the embroidering frame B will be described. The embroidering frame B is substantially composed of a frame 10 for tightly holding a piece of cloth and an arm 11 having one end fixedly connected to the frame 10 and the opposite free end to be connected to the mount 3. The frame 10 includes an outer frame member 10*a* and an inner frame member 10*b* which are so assembled as to hold the cloth in cooperation. The arm 11 is provided with a connector 13 at the free end thereof, the connector 13 being a screw having a knob, that is, a thumbscrew which is accessible for securing and removing the embroidering frame B to and from the mount 3 of the carriage A.

Figure 4:
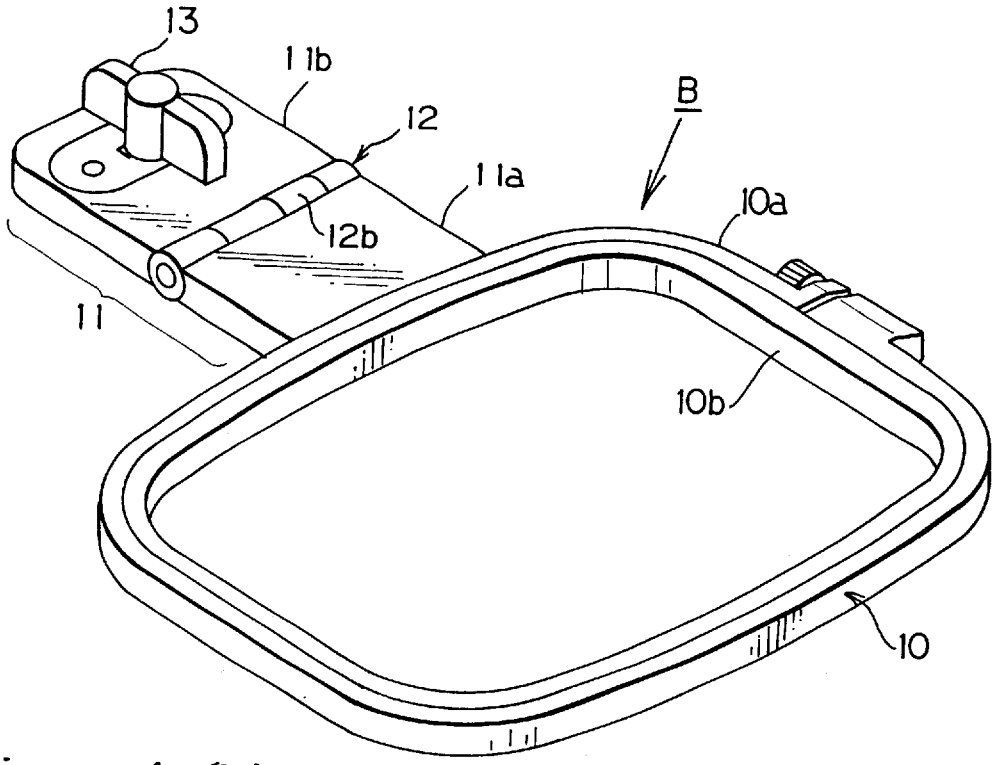
Figure 4:
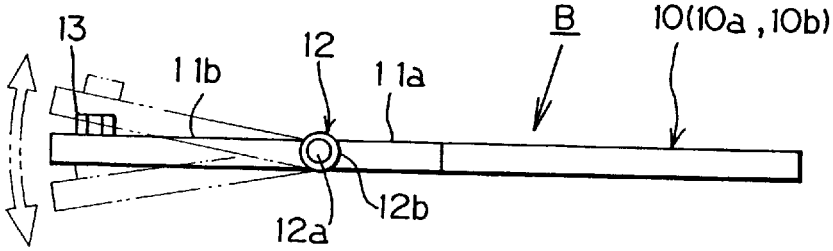
Figure 4:
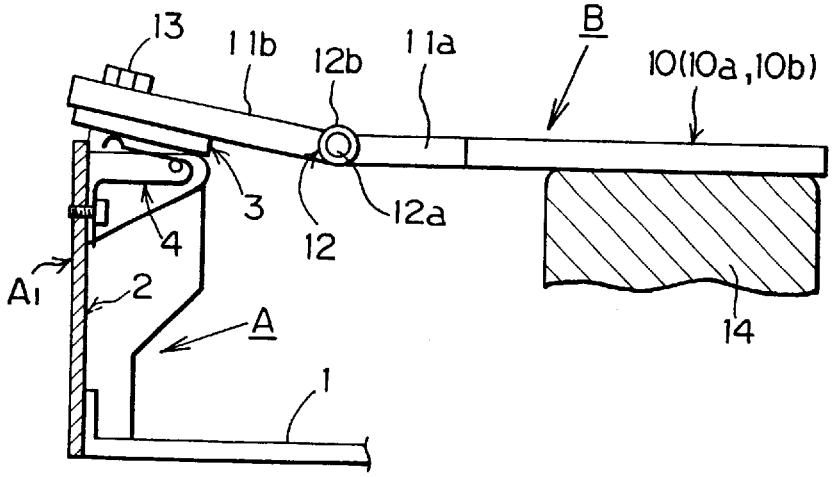

Further, the arm 11 is divided in two portions 11*a,* 11*b* at the longitudinally intermediate portion thereof, and the two portions 11*a,* 11*b* are connected to each other with a flexible member 12, that is, a flexible coupling so that the arm portions 11*a,* 11*b* may be elastically deflected up and down at the flexible member 12 as shown in FIG. 4(*b*).

As shown in FIGS. 4(*a*) to (*c*), the flexible member 12 is a hinge type flexible coupling having the opposite sides fixedly connected to the opposite ends of the arm portions 11*a,* 11*b* respectively to normally maintain the arm portions 11*a,* 11*b* in a horizontal plane. The hinge type flexible member 12 has a center shaft 12*a* inserted into a hole 12*b* formed as extending axially of the hinge body, so that the arm portions 11*a,* 11*b* connected to the hinge type flexible member 12 may be pivotally moved around the center shaft 12*b*. Namely, the arm 11 is swingable around the center shaft 12*a*.

Figure 5:
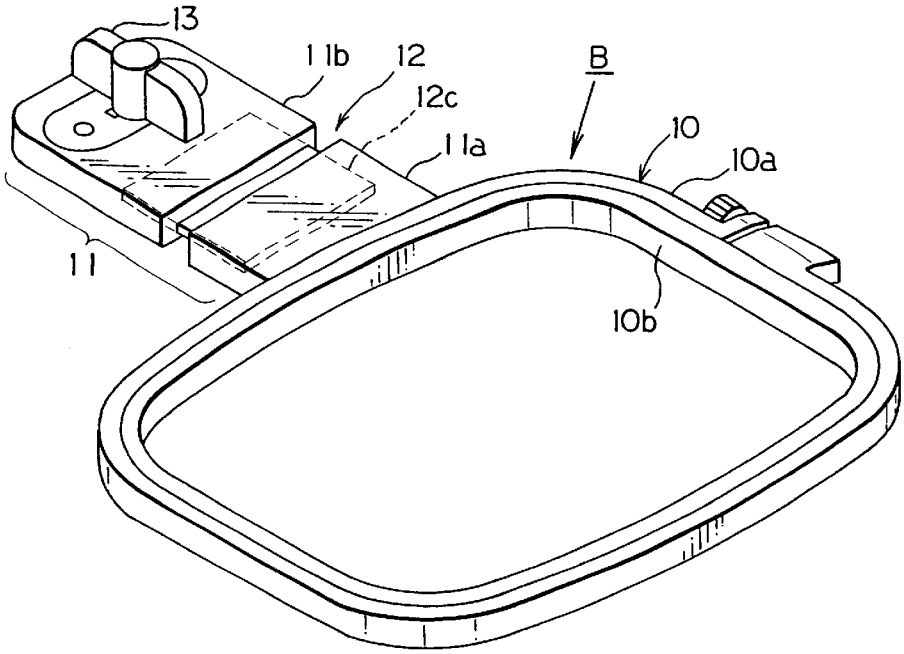
Figure 5:
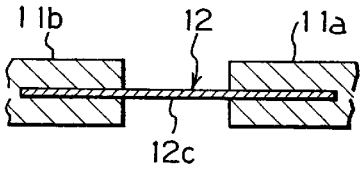
Figure 5:
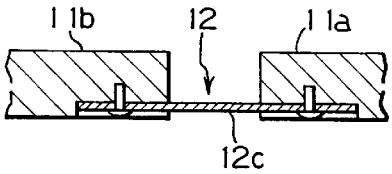
Figure 5:
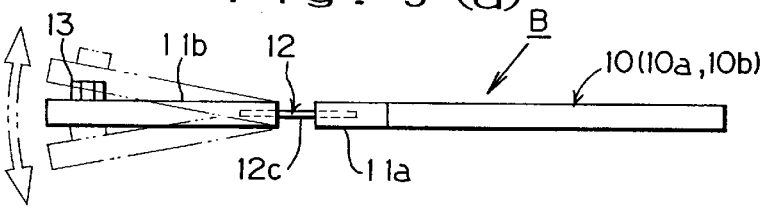
Figure 5:
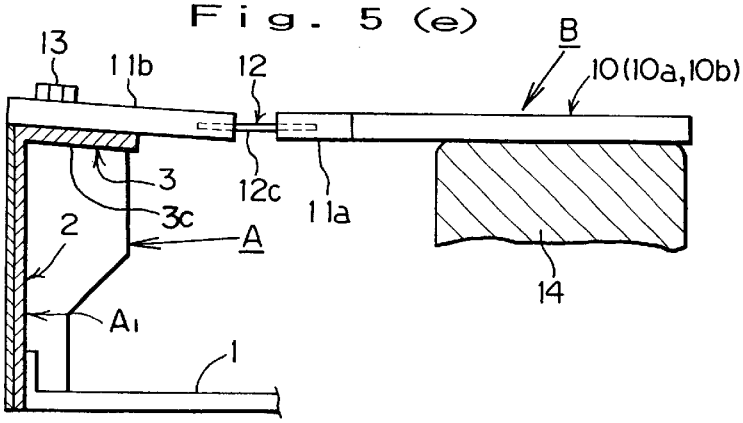
Figure 6:
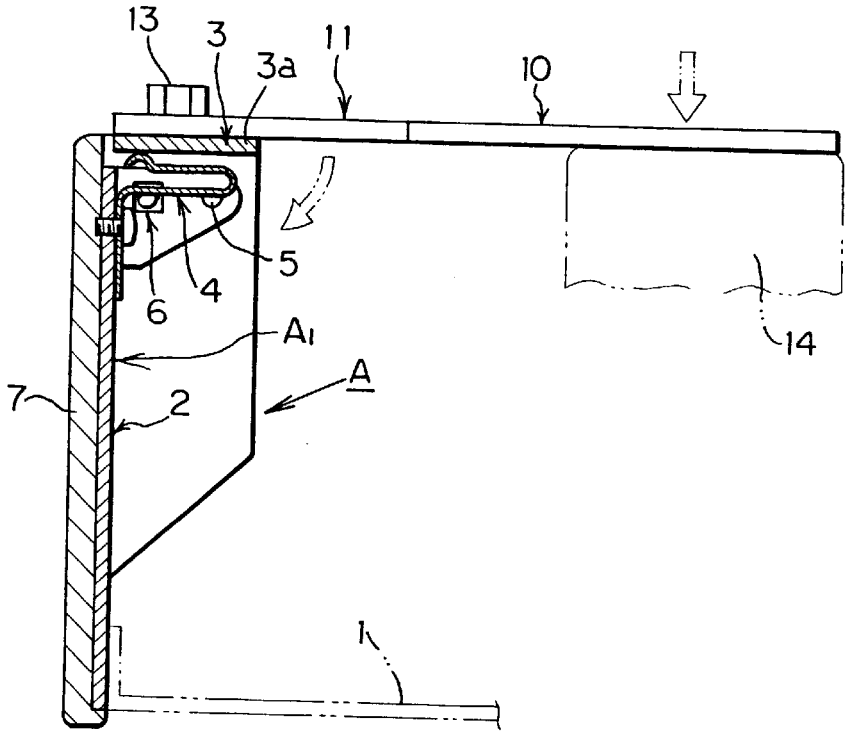
Figure 6:
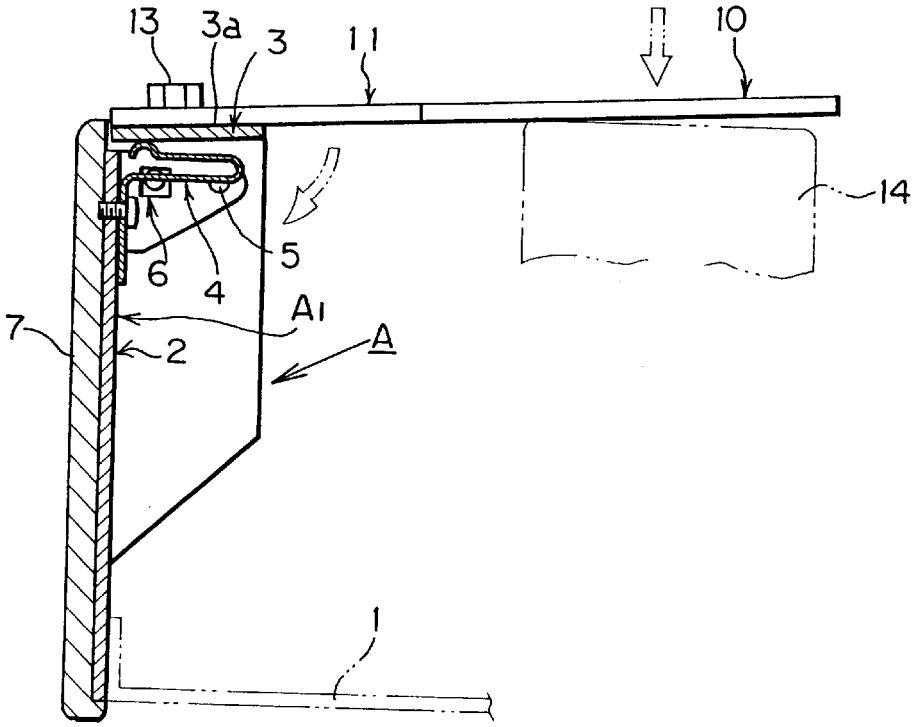
Figure 7:
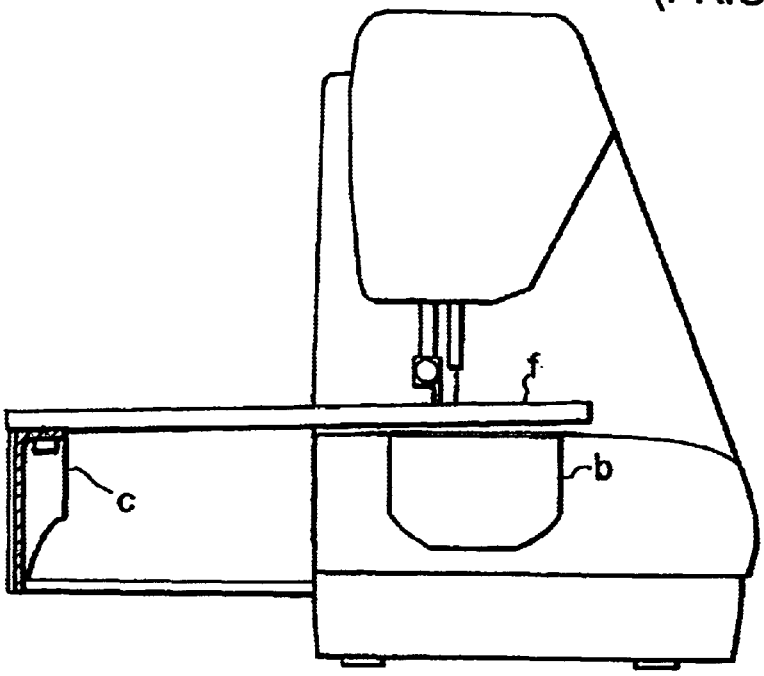
Fig. 7 (a) (PRIOR ART)
Figure 7:
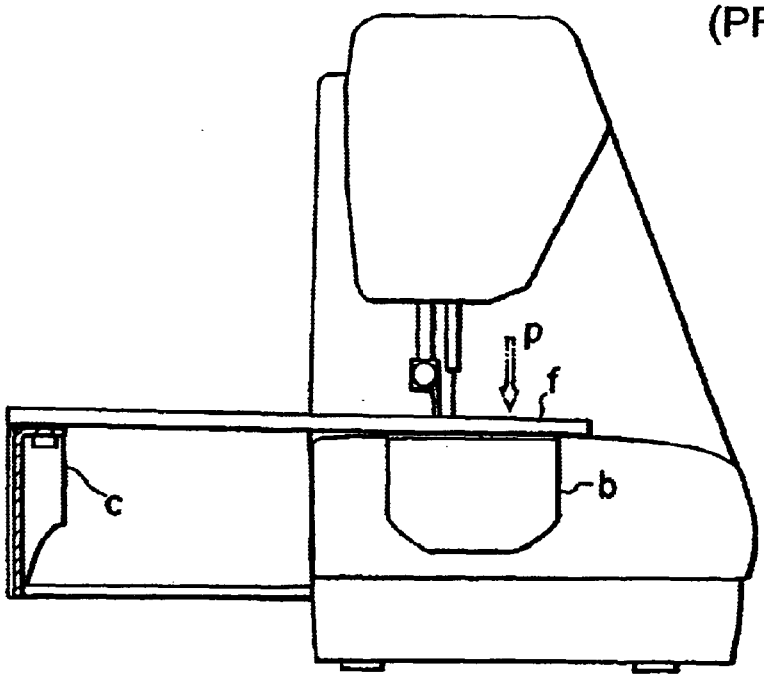
Fig. 7 (b) (PRIOR ART)

FIG. 5 (*a*) shows a second embodiment of the flexible member 12 which is a flat elastic plate 12*c* having the opposite sides fixedly connected to the opposite ends of the arm portions 11*a,* 11*b* respectively are fixedly inserted into the opposite ends of the arm portions 11*a,* 11*b* respectively or fixedly connected to the opposite ends of the arm portions 11*a,* 11*b* respectively at the underside thereof as shown in FIGS. 5 (*b*) and (*c*), thereby to normally maintain the arm portions 11*a,* 11*b* in horizontal plane as shown in FIGS. 5 (A) and (B), but allow the same to deflect up and down by external force applied thereto as shown in FIG. 5 (*d*).

In case the embroidering frame B of the flexible member 12 according to the second embodiment is used, the mount 3 of the carriage A is fixedly connected to the top of the support plate 2 instead of being rotatable thereat as shown in FIG. 5 (*e*). In this case, the surface 3*c* of the mount 3 is inclined as it is progressively lowered towards the sewing machine bed 14 so that the embroidering frame B, that is, the frame 10 (10*a,* 10*b*) may be pressed against the surface of the sewing machine bed 14 by the elastic force of the flat elastic plate 12*c* when the embroidering frame B is mounted to the mount 3 of the carriage A by means of the thumbscrew 13.

With the carriage A and the embroidering frame B being structured as described above, in case the embroidering frame B is mounted to the mount 3 of the carriage A by means of the thumbscrew 13 located at the free end of the arm 11 of the embroidering frame B while the frame 10 (10*a,* 10*b*) secured to the opposite end of the arm 11 is placed on the machine bed 14 as shown in FIGS. 1 and 3(*a*), the frame 10 (10*a,* 10*b*) of the embroidering frame B is pressed against the surface of the machine bed 14 by the elastic force of the elastic member 4 having a predetermined suitable force which will allow the embroidering frame B to smoothly and steadily move in X-Y direction on the machine bed 14.

Since the mount 3 is prevented from rotating beyond predetermined angular limits defined by the regulating means 6, the frame 10 (10*a,* 10*b*) of the embroidering frame B may be placed on the surface of the machine bed 14 with an optimal pressure applied thereto which is not so strong as to brake the movement of the embroidering frame B. Further, since the mount 3 is so formed as to slightly incline as it is progressively lowered towards the machine bed 14, the embroidering frame B may be easily mounted to the mount 3 in spite of the inclination.

Further, in case the embroidering frame B has the elastic member 12 provided at the arm 11 thereof and is mounted to the mount 3 which is fixedly connected to the support plate 2 of the carriage A and inclined as it is progressively lowered towards the machine bed 14 as shown in FIGS. 4 (*c*) and 5 (*e*), the frame 10 (10*a,* 10*b*) of the embroidering frame B may contact the surface of the machine bed 14 in parallel with each other without a gap therebetween because the arm portion 11*a* may be deflected up due to the elasticity of the elastic member 12 while pressing the frame 10 (10*a,* 10*b*) against the surface of the machine bed 14.

As is described above, according to the invention, the sewing machine is provided with means for driving, in X-Y direction relative to a vertically reciprocating needle, an embroidering frame B holding a piece of cloth to be stitched and means for pressing the embroidering frame against the surface of the machine bed 14. Therefore, the embroidering frame B may be moved in X-Y direction while the same is pressed against the surface of the machine bed 14 with a suitable force which will allow smooth and steady movement of the embroidering frame B instead of braking the movement of the same, without vibration and/or floating up from the surface of the machine bed 14 which may otherwise be caused during embroidery stitching operation.

What is claimed is:

1. A sewing machine having a capability of damping vibrations of an embroidering frame during operation, said sewing machine comprising:

a drive mechanism for moving said embroidering frame;

frame holding means for holding said embroidering frame, said holding means being connected to and driven by said drive mechanism to move said embroidering frame, relative to a reciprocating needle, on a surface of a machine bed; and vibration absorbing means for absorbing vibrations of said embroidering frame during operation.

2. The sewing machine as defined in claim 1, wherein said vibration absorbing means is so formed as to press said embroidering frame against the surface of said machine bed.

3. The sewing machine as defined in claim 1, wherein said vibration absorbing means include a spring means connected to said frame holding means and normally pressing down said embroidering frame.

4. The sewing machine as defined in claim 1, wherein said vibration absorbing means include a member for providing an inclined surface and said embroidering frame is provided with a spring means for pressing said embroidering frame against the surface of said machine bed in cooperation with said inclined surface.

5. An embroidering frame having a capability of damping vibrations thereof during operation with a sewing machine, said embroidering frame comprising:

a frame portion for holding a piece of cloth to be stitched;

an arm portion having a first end fixedly connected to said frame portion and an opposite, second end adapted to be connected to frame holding means of the sewing machine, said arm portion having at least a part moveable with respect to said frame portion, wherein said arm portion includes a flexible member for allowing said arm portion to, at least partially, rotate relative to said frame portion to adjustably press said frame portion against a surface of a machine bed of the sewing machine; and means for regulating the rotation movement of said arm portion.

6. The sewing machine as defined in claim 2, wherein said vibration absorbing means includes a spring means provided in connection with said frame holding means and normally pressing down said embroidering frame.

7. The sewing machine as defined in claim 2, wherein said vibration absorbing means includes a member for providing an inclined surface and said embroidering frame is provided with a spring means for pressing said embroidering frame against the surface of said machine bed in cooperation with said inclined surface.

8. In combination, a sewing machine and an embroidering frame for use with said sewing machine;

said sewing machine comprising:

a drive mechanism for moving said embroidering frame;

a stationary machine bed;

a reciprocating needle moving relative to a working surface of said machine bed; and a moveable support holding said embroidering frame, said support being connected to and driven by said drive mechanism to move said embroidering frame relative to the working surface of said machine bed, said support having a spring for damping vibrations of said embroidering frame during operation; and said embroidering frame comprising first and second frame elements fastenable together to hold a piece of cloth to be stitched.

9. The combination of claim 8, wherein said embroidering frame further comprises a bolt for fastening the first and second frame elements together.

10. The combination of claim 8, wherein an entirety of said embroidering frame is biased by said spring in the same direction to be pressed against the working surface of said machine bed.

11. The combination of claim 8, wherein said support further includes a first support element connected to said drive mechanism and a second support element movable with respect to said first support element and connected to said embroidering frame, said spring being placed between said first and second support elements.

12. The combination of claim 11, wherein said second support element has a surface to which said embroidering frame is attached, said spring biasing said second support element to incline said surface towards said machine bed.

13. The combination of claim 11, wherein said support further includes at least one stop different from said spring for limiting relative movement between said first and second support elements.

* * * * *